United States Patent [19]

Verweij

[11] Patent Number: 4,793,247

[45] Date of Patent: Dec. 27, 1988

[54] METHOD OF MIXING TWO OR MORE GAS FLOWS

[75] Inventor: Kees Verweij, Beverwijk, Netherlands

[73] Assignee: Hoogovens Groep B.V., IJmuiden, Netherlands

[21] Appl. No.: 91,980

[22] Filed: Sep. 1, 1987

[30] Foreign Application Priority Data

Sep. 16, 1986 [NL] Netherlands ..... 8602338

[51] Int. Cl.[4] ..... B01F 5/00; B01F 13/00

[52] U.S. Cl. ..... 366/338; 55/DIG. 29; 98/38.8; 366/336; 366/348

[58] Field of Search ..... 366/336, 337, 338, 340, 366/348, 341, 177, 181; 98/38.8, 38.9; 55/DIG. 29; 138/38, 39, 42; 165/59, 96; 162/343

[56] References Cited

U.S. PATENT DOCUMENTS

| | | | |
|---|---|---|---|
| 3,212,424 | 10/1965 | Davis . | |
| 3,448,968 | 6/1969 | Young | 366/338 X |
| 3,632,090 | 1/1972 | White | 366/338 |
| 4,112,520 | 9/1978 | Gilmore | 366/338 X |
| 4,205,921 | 6/1980 | Mahler | 366/338 |

FOREIGN PATENT DOCUMENTS

| | | |
|---|---|---|
| 2844046 | 4/1980 | Fed. Rep. of Germany . |
| 3217803 | 11/1983 | Fed. Rep. of Germany . |
| 1236255 | 6/1960 | France . |
| 1261312 | 4/1961 | France . |
| 612012 | 11/1948 | United Kingdom . |

*Primary Examiner*—Timothy F. Simone

*Attorney, Agent, or Firm*—Stevens, Davis, Miller & Mosher

[57] ABSTRACT

In a method of mixing two or more gas flows, the gas flows are passed through an array of at least three parallel adjacent guide conduits so as to emerge from said conduits into a mixing zone as a corresponding array of parallel adjacent streams flowing in the same direction. The gas flows are distributed alternatingly in said conduits so that each said stream has, as each of its neighbors, a gas stream from a different said gas flow. To improve mixing and shorten the required length of the mixing zone, the streams derived from the respective gas flows have different velocities at their emergence from the guide conduits into the mixing zone.

11 Claims, 2 Drawing Sheets

METHOD OF MIXING TWO OR MORE GAS FLOWS

BACKGROUND OF THE INVENTION

1. Field of the Invention

The invention relates to a method of mixing a plurality of gas flows, e.g. two gas flows, which may be at different temperatures.

2. Description of the Prior Art

Gas mixers of the static type having fixed swirl bodies such as baffles in the gas mixing conduit are well known in practice. A disadvantage of these conventional gas mixers of the static type is that mixing is not quickly achieved, so that they require a great installation length.

GB-A-612012 describes a gas mixer of the static type in which two air flows of different temperatures are each sub-divided into a number of streams which are "interleaved" i.e. emerge into a mixing zone from an array of parallel elongate slots with the streams of the respective flows alternating along the array. It is said that good mixing is promoted by the turbulent state of the air caused by the passage of air between the closely adjacent walls. In fact the use of narrow slots will tend to produce laminar flow.

FR-A-1 235 255 discloses a similar mixer using a bent metallic sheet to provide an array of the parallel slots for two gas flows of different temperatures.

SUMMARY OF THE INVENTION

The object of the invention is to achieve an improved method of mixing gas flows using an array of adjacent conduits from which the flows emerge alternatingly by reducing the length of the mixing zone required after exit from the conduits for good mixing.

The present invention consists in a method of mixing two or more gas flows in which the gas flows are passed through an array of at least three parallel adjacent guide conduits so as to emerge from said conduits into a mixing zone as a corresponding array of parallel adjacent streams flowing in the same direction, the gas flows being distributed alternatingly in said conduits so that each said stream has as each of its neighbours, a gas stream from a different said gas flow, characterised in that the streams derived from the respective gas flows have different velocities at their emergence from the guide conduits into the mixing zone.

The present invention lies in providing in the mixing zone an array of gas streams with differing velocities across the array. Each stream then "erodes" its neighbour or neighbours to produce initially rough turbulence due to eddy diffusion. The quantity of energy represented by the different velocities causes this rough turbulence to break up into fine turbulence which achieves good mixing of the gases over a short length of mixing zone. For example, the distance along the mixing zone before good mixing is achieved may be as little as 30 times the width of the mouths of the conduits of the array.

The length of mixing zone will generally be dependent upon the relative velocities of the gas streams. Preferably the velocity difference between the neighboring streams at emergence from the guide conduits is at least 2 m/s, more preferably at least 5 m/s and more preferably at least 10 m/s. A velocity differential of at least 15 m/s may be suitable where larger volumes are concerned.

The flow cross section areas of the conduits for the different gas flows are preferably chosen in accordance with the relative volumes of the gas flows and the relative velocities at emergence into the mixing zone. For example with two flows of approximately equal volume, the flow cross section areas must be different for the two gas flows, so that the desired velocity differences are achieved. The method of the invention is also suitable for mixing gas flows of substantially different volumes, e.g. 10:1.

Preferably the guide conduits, at their mouth directed into the mixing zone, have a cross sectional shape of a slot, with all of the slots parallel to each other.

The slot width is preferably chosen in dependence on the relative velocities of the gas streams and the relative volumes of the gas flows. If the slots are wide, to achieve good mixing in a short mixing zone, the relative velocities of the gas stream must be higher. With narrower slots, a smaller velocity difference of the gas streams can achieve mixing, but in that case there may be greater pressure drop across the system. When there is a high velocity difference between the gas streams of the two gas flows, the gas flow of higher velocity may exert a suction effect on the gas flow of lower velocity, which is advantageous for example where a gas flow of high temperature is mixed with a gas flow of lower temperature, since a fan may be used only for the gas flow of lower temperature. Consequently, a fan capable of resisting the temperature of the high temperature gas can be avoided.

Preferably the slot width is in the range 7 to 40 cm, more preferably 10 to 25 cm.

With two gas flows, the total number of guide conduits is preferably at least five.

BRIEF INTRODUCTION OF THE DRAWINGS

Embodiments of the method of the invention are described below by way of non-limitative example with reference to the accompanying drawings, in which:

FIG. 1 is a perspective view of a gas mixer suitable for use in carrying out the method of the invention, and FIG. 2 is a graph illustrating the results achieved in the Examples.

DESCRIPTION OF PREFERRED EMBODIMENT

Figure 1:
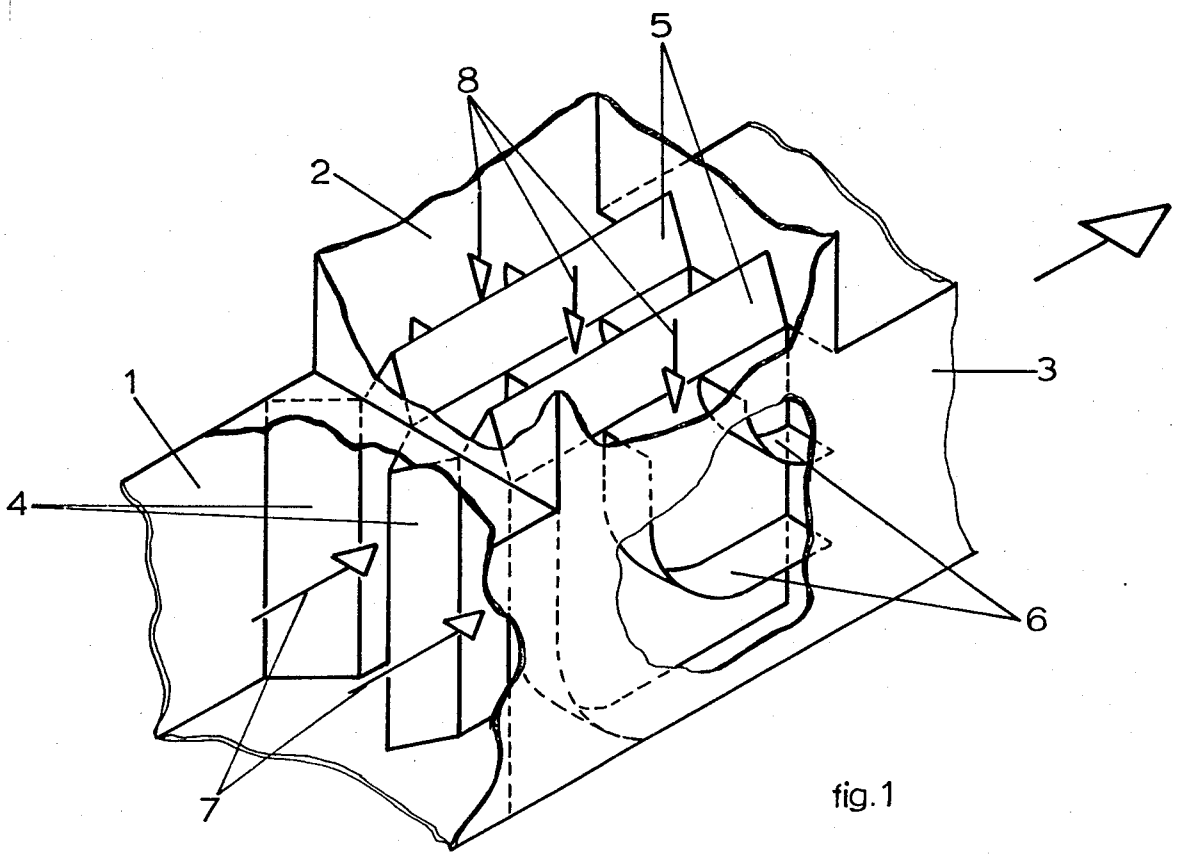

FIG. 1 shows a first supply duct 1 which joins a second supply duct 2. The two ducts 1 and 2 carry respective gas flows to be mixed. In the duct 1 thin-walled partitions 4 are present which divide the gas flow in the duct into a plurality of streams indicated by arrows 7. The gas flow in the second supply duct 2 is similarly divided into a plurality of streams 8 by the partitioning 5, these streams being interleaved between the streams of the flow in the duct 1. The gas mixer thus provides an array of conduits, here five in total, which are alternately connected to the two supply ducts 1,2 and discharge the streams 7,8 at their exits as parallel adjacent streams directed in the same direction into a mixing zone constituted by a discharge duct 3. In addition in the conduits for the streams 8, guides 6 are arranged to deflect the gas streams in the direction of the discharge duct 3 so that the pressure loss occurring is limited.

In this mixer the conduits for the streams 7,8 are of the same width. To perform the invention, the flows in the ducts 1,2 are adjusted so that the two streams 7 and three streams 8 emerge into the discharge duct 3 with different velocities.

EXAMPLES OF THE INVENTION

In a test apparatus, the results of mixing a gas flow with a temperature of about 25° C. with a gas flow with a temperature of about 145° C. were obtained. For this a gas mixer was used consisting of a total of three parallel conduits of slot shape. Flowing through the middle conduit was the hotter gas flow, and the colder gas flow passed through the conduits on either side. Three parallel adjacent streams thus passed into a mixing zone.

To assess the degree of mixing, the mixing zone contains, at an adjustable distance from the conduits a wire network whose temperature can be measured at each wire crossing point.

The width of the conduits was selected so that the hot gas flow passes through conduit of width B, and the cold gas stream flowed through two conduits each with a width of about 0.5 B.

In order to be able to assess the homogeneity of the mixed gas, use is made of the concept of relative standard deviation, based on the differences of temperature in the gas, measured by the wire network.

With good mixing the relative standard deviation will be smaller than 3%, poor mixing on the other hand gives higher values. The following tests were carried out:

Test 1 In this test the measurements were carried out at a differential velocity between the cold and hot gas streams at exit from the conduits into the mixing zone of 17.5 m/s:

velocity, quantity cold gas stream 22.8 m/s, 113 t/h velocity, quantity of hot gas stream 5.3 m/s, 22 t/h The width B of the hot air stream in this test is set at 68.5 mm.

Figure 2:
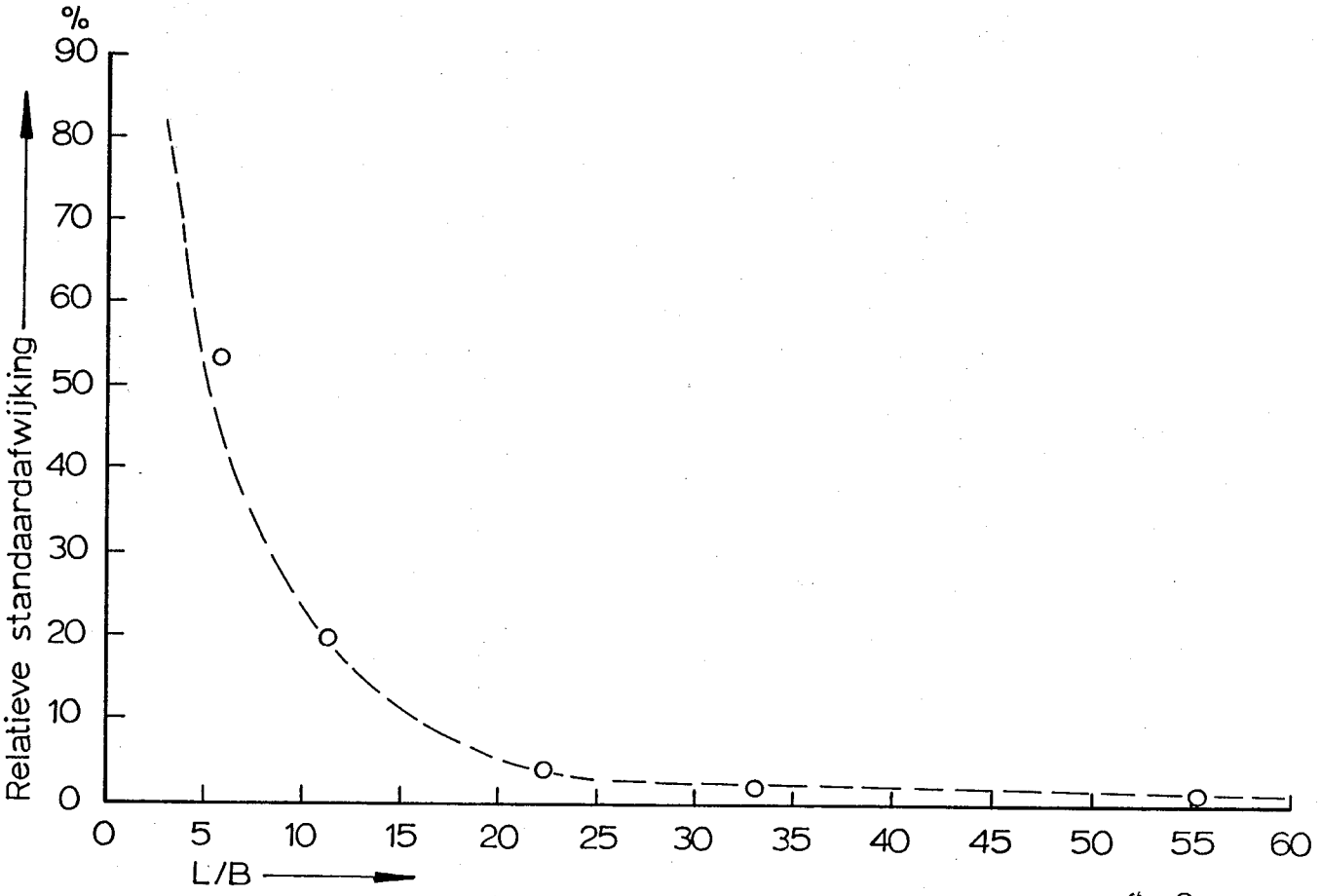

In FIG. 2 the results are shown in graph form. On the vertical axis the relative standard deviation is expressed and on the horizontal axis the ratio of the distance L, which is the distance between the point where the gas streams meet first and where good mixing is achieved, to the width B of the hot air stream.

At each measurement point, the measurement is repeated a few times. The average results are processed in the graph. The graph shows that with a ratio of L/B=20 good mixing can be achieved.

Test 2 Test 1 was repeated, with width 13 set at 42 mm. The graph of results processed in the same way did not show any significantly different curve.

Although in these tests slot widths of 68.5 and 42 mm were used, in practice higher slot width of 7 to 40 cm, more preferably 10 to 25 cm are effective.

What is claimed is:

1. A method of mixing at least two gas flows comprising passing each gas flow through an array of at least three parallel adjacent guide conduits, causing the flows to emerge from said conduits into a mixing zone as an array of parallel adjacent streams flowing in the same direction, and mixing said gas flows together in the mixing zone, with the gas flows entering said mixing zone being distributed alternatingly in said conduits so that each said stream has, as an adjacent gas stream, a gas stream from a different gas flow and with the streams derived from the respective gas flows having different velocities at their emergence from the guide conduits into the mixing zone.

2. A method according to claim 1 wherein the velocity difference between the streams of two said gas flows respectively at emergence from the guide conduits is at least 2 m/s.

3. A method according to claim 2 wherein said velocity difference is at least 5 m/s.

4. A method according to claim 3 wherein said velocity difference is at least 10 m/s.

5. A method according to claim 1 wherein each guide conduit containing a first one of said gas flows has a flow cross section area which is greater than the flow cross section area of each guide conduit containing a second said gas flow.

6. A method according to claim 1 wherein at their mouths opening into the mixing zone said conduits each have a slot shape in cross section perpendicular to the gas flow direction.

7. A method according to claim 6 wherein the slots are rectangular and have their elongate axes parallel to each other.

8. A method according to claim 6 wherein the width of each slot is in the range 7 to 40 cm.

9. A method according to claim 8 wherein the width of each slot is in the range 10 to 25 cm.

10. A method according to claim 1 wherein there are two said gas flows and the total number of said guide conduits is at least five.

11. A method of mixing at least two gas flows including the steps of (a) providing an array of at least three parallel adjacent guide conduits all opening into a mixing zone, (b) distributing said gas flows into said conduits to form stream s therein in a manner such that each said stream has in each conduit adjacent to it a stream derived from a different one of said gas flows, (c) causing said streams to emerge from said conduits into said mixing zone with velocities which, for each gas flow, differ from the velocity of the streams derived from each other gas flow.

* * * * *